US009422686B2

(12) United States Patent
Maritz et al.

(10) Patent No.: US 9,422,686 B2
(45) Date of Patent: Aug. 23, 2016

(54) FACING ELEMENT WITH INTEGRATED COMPRESSIBILITY AND METHOD OF USING SAME

(75) Inventors: Louwtjie Maritz, Gauteng (ZA); Nicolas Freitag, Orsay (FR)

(73) Assignee: TERRE AREMEE INTERNATIONALE, Velizy Villacoublay (FR)

( * ) Notice: Subject to any disclaimer, the term of this patent is extended or adjusted under 35 U.S.C. 154(b) by 0 days.

(21) Appl. No.: 13/989,746

(22) PCT Filed: Nov. 26, 2010

(86) PCT No.: PCT/IB2010/003430

§ 371 (c)(1),
(2), (4) Date: May 24, 2013

(87) PCT Pub. No.: WO2012/069868

PCT Pub. Date: May 31, 2012

(65) Prior Publication Data

US 2013/0259583 A1 Oct. 3, 2013

(51) Int. Cl.

| | |
|---|---|
| ***E02D 29/02*** | (2006.01) |
| ***E02D 17/18*** | (2006.01) |
| ***E02D 17/20*** | (2006.01) |

(52) U.S. Cl.

CPC ..... *E02D 17/18* (2013.01); *E02D 17/205* (2013.01); *E02D 29/0216* (2013.01)

(58) Field of Classification Search

CPC ..... E02B 3/04
USPC ..... 405/284, 286, 272, 302.4, 302.6, 285
See application file for complete search history.

(56) References Cited

U.S. PATENT DOCUMENTS

| | | | | |
|---|---|---|---|---|
| 4,324,508 | A * | 4/1982 | Hilfiker et al. | 405/284 |
| 4,514,113 | A * | 4/1985 | Neumann | 405/286 |
| 8,579,549 | B2 | 11/2013 | Freitag et al. | |
| 8,616,807 | B2 * | 12/2013 | Ogorchock | 405/262 |

FOREIGN PATENT DOCUMENTS

| | | | |
|---|---|---|---|
| DE | 30 34 452 | A1 | 5/1981 |
| EP | 0 285 465 | A1 | 10/1988 |
| EP | 1 662 050 | A1 | 5/2006 |
| JP | 50-203732 | A | 10/1985 |
| JP | 2006-052606 | A | 2/2006 |
| JP | 2007-332713 | A | 12/2007 |

* cited by examiner

*Primary Examiner* — Sean Andrish
(74) *Attorney, Agent, or Firm* — Dentons US LLP

(57) ABSTRACT

A facing element for reinforced soil structures and method of using same to build a reinforced soil structure, the facing element including a first facing sub-element with at least one connecting member to connect at least one reinforcement member to said first facing sub-element, a second facing sub-element, and a linking device. Wherein said first and second facing sub-elements are separated by a gap and are linked together by the linking device such that the first and second facing sub-elements have a constant relative position.

11 Claims, 3 Drawing Sheets

FACING ELEMENT WITH INTEGRATED COMPRESSIBILITY AND METHOD OF USING SAME

This Application is a 35 U.S.C. §371 National Stage of, and claims priority to, International Application No. PCT/IB2010/003430, filed Nov. 26, 2010, which is incorporated by reference in its entirety herein.

FIELD OF INVETION

The present invention relates to the construction of reinforced soil structures. This building technique is commonly used to produce structures such as retaining walls, bridge abutments, etc.

BACKGROUND OF THE INVENTION

A reinforced soil structure combines a compacted fill, a facing and reinforcements usually connected to the facing.

Various types of reinforcement can be used: metal (for example galvanized steel), synthetic (for example based on polyester fibers), etc. They are placed in the earth with a density that is dependent on the stresses that might be exerted on the structure, the thrust of the soil being reacted by the friction between the earth and the reinforcements.

The facing is usually made from prefabricated concrete elements, in the form of panels or blocks, juxtaposed to cover the front face of the structure.

There may be horizontal steps on this front face between various levels of the facing, when the structure incorporates one or more terraces. In certain structures, the facing may be built in situ by pouring concrete or a special cement.

It is well known in the art that the facing has to be compressible in order to follow the possible deformations of the structure due to the contraction of the fill for example.

Usually, prefabricated concrete facing elements do not offer a sufficient compressibility to follow the contraction of the fill. In order to improve the situation, a method consists in introducing a compressive material between successive facing elements. In such case, the vertical soil structures are limited to around 20 meters height with a high quality fill material compacted according to the state of the art methods.

There is a need of reinforced soil structure with vertical walls of important height, particularly in quarries and mining exploitations.

BRIEF SUMMARY OF THE INVENTION

An object of the present invention is to propose a novel facing element which may be used so as to build a reinforced soil structure that does not present the above-mentioned problems.

The invention thus proposes a facing element for reinforced soil structures comprising a first facing sub-element comprising at least one connecting member configured to connect at least one reinforcement member to said first facing sub-element, a second facing sub-element and a linking device, wherein said first and second facing sub-elements are separated by a gap and are linked together by the linking device such that the first and second facing sub-elements have constant relative position.

Advantageously, a facing element according to the invention may be integrated into a facing of a reinforced soil structure providing a greater compressibility to the facing, than a prior art concrete facing element, in particular once the linking device is released or removed.

According to further embodiments of the invention, the facing element according to the invention may comprise the following features alone or in combination:

- said second facing sub-element comprises at least one connecting member configured to connect at least one reinforcement member to said second facing sub-element,
- the gap is filled with a material having a compressibility such that the overall compressive strain capacity of the facing element in at least one direction is comprised between 0.5% and 20%,
- the material filling the gap has a compressibility such that the overall compressive strain capacity of the facing element in at least one direction is comprised between 1% and 5%,
- the linking device is configured so as to be removed or released when the facing element is part of a reinforced soil structure,
- the linking device is arranged so as to break under a force greater than two times the weight of the said facing element,
- the linking device is arranged so as to naturally deteriorate over time.

The invention further relates to a facing element for reinforced soil structures comprising at least two facing elements as described above and a secondary linking device, wherein the at least two facing elements are separated by a second gap and linked together by the secondary linking device such that the at least two facing elements have constant relative position.

According to an embodiment of the invention, the second gap separating the at least two facing elements has a longitudinal direction substantially perpendicular to the longitudinal direction of the gaps separating the sub-elements forming said facing elements.

The invention also relates to a reinforced soil structure comprising a fill, a facing made of facing elements placed along a front face of the structure and each facing element being connected to at least one reinforcement member extending through a reinforced zone of the fill situated behind said front face wherein the facing comprises, at least, one facing element according to any of the preceding claims, at least one facing sub-element of said facing element being connected to, at least, a reinforcement member extending through a reinforced zone of the fill situated behind said front face.

According to further embodiments of the invention, the reinforced soil structure according to the invention may comprise the following features alone or in combination:

- the facing comprises, at least, one row of elements according to the invention, at least one facing sub-element of said facing elements being connected to, at least, a reinforcement member extending through a reinforced zone of the fill situated behind said front face,
- the reinforcement members are selected among the following list consisting of: synthetic strip, metal strip, metal bar, strip shaped metal grid, sheet shaped metal grid, ladder shaped metal grating, synthetic strip, sheet shaped synthetic grid, ladder shaped synthetic grid, geotextile layer, and geocell.

Another aspect of the invention relates to a method for building a reinforced soil structure, comprising the steps of:

- positioning a facing element according to the invention along a front face of the structure delimiting a volume to be filled,
- connecting at least one reinforcement member to a connecting member of one facing sub-element so as to have the reinforcement member extend through a reinforced zone situated behind said front face, introducing fill material into said volume over, at least, the reinforced zone in which the reinforcement member extends, and compacting the fill material.

According to an embodiment of the invention, the building method may further comprise the step of removing the linking device between facing sub-elements.

BRIEF DESCRIPTION OF THE DRAWINGS

Non limiting embodiments of the invention will now be described with reference to the accompanying drawing wherein.

DETAILED DESCRIPTION

In the sense of the invention, the back face of a facing element or sub-element corresponds to the face that is to be in contact with the fill when said facing element or sub-element is part of a reinforced soil structure.

In the sense of the invention, the front face of a facing element or sub-element corresponds to the face opposite to the back face.

Figure 1:
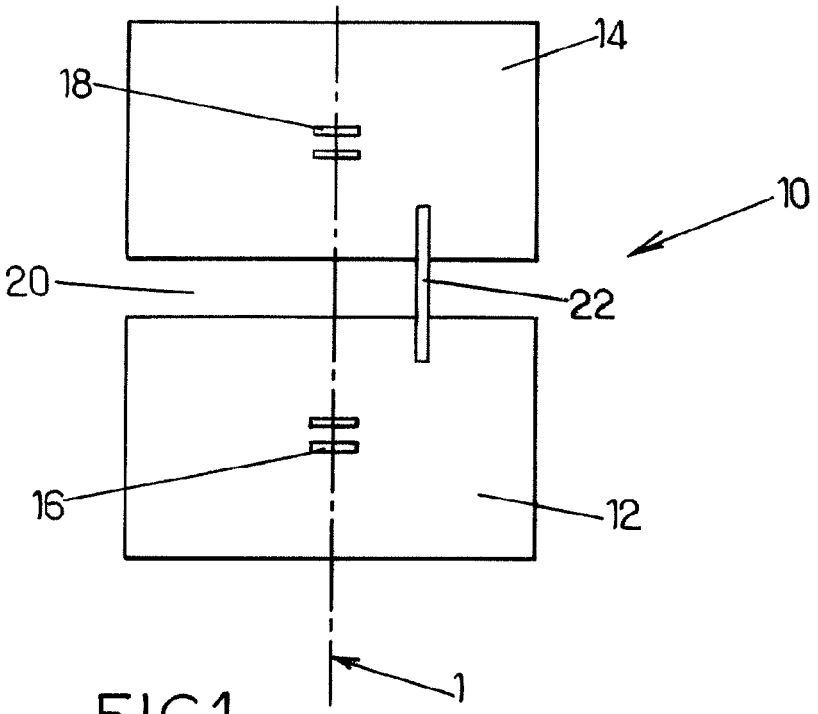
FIG. 1 is a schematic back view of a first embodiment of a facing element according to the invention.

According to a first embodiment, the invention proposes a facing element 10 as depicted on FIG. 1. Said facing element comprises two sub-elements 12 and 14. For example, these sub-elements are two concrete or reinforced concrete panels. Such panels may have different types of shapes, for example a substantially rectangular shape. Each of said sub-elements also comprises at least a connecting member 16 and 18. Said connecting members are configured to connect at least one reinforcement member to the facing sub-elements. In an embodiment of the invention, only one sub-element 12 or 14 comprises a connecting member 16 or 18.

As shown in FIG. 1, the two sub-elements 12 and 14 are separated by a gap 20, and are linked together by a linking device 22. The linking device is configured to keep the two sub-elements at a constant relative position when no additional stress is applied on the facing element than its own weight. For example, the linking device is an iron patch bolted to the sub-elements.

According to an embodiment of the invention, the linking device 22 is designed so as to be removable or releasable. Thus mobility between the two sub-elements can be obtained, for example once the facing element is part of a reinforced soil structure, giving to the facing element a greater compressibility. For example, the linking device 22 is arranged so as to break under a force greater than two times the weight of the said facing element. According to an embodiment of the invention, the linking device is arranged so as to naturally deteriorate over time, for example it is made in a material that deteriorates over 2 to 5 years.

Advantageously, a facing element according to the invention may be integrated into a facing of a reinforced soil structure providing a greater compressibility to the facing, than a prior art concrete facing element, in particular once the linking device is released or removed.

According to an embodiment of the invention, the gap 20 may be, at least, partially filled with a compressive material, for example polystyrene, EPDM, polyethylene or cork. For example, a brick of compressive material is introduced into the gap. The size of the gap and the filling material can be advantageously chosen in order to obtain a desired compressibility of the facing element. For example, the gap is filled with a material having a compressibility such that the overall compressive strain capacity of the facing element in at least one direction is comprised between 0.5% and 20%, preferably, between 1% and 5%. For example, the direction 1 in which the overall compressive strain capacity of the facing element is adapted is a direction substantially perpendicular to the longitudinal direction of the gap, as shown on FIG. 1.

Figure 2:
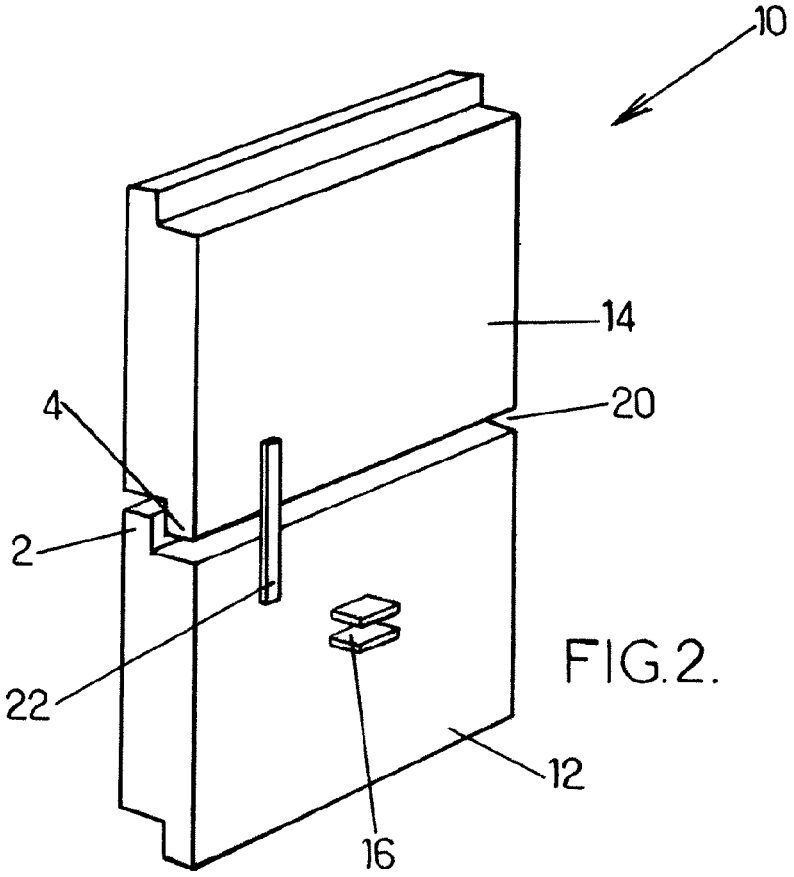
FIG. 2 is a schematic perspective view of a second embodiment of a facing element according to the invention.

FIG. 2 depicts a second embodiment of a facing element according to the invention. The facing element comprises a first sub-element 12 and a second sub-element 14, separated by a gap 20 and linked together by a linking device 22. The specifications of this facing element are substantially the same as recited above for the facing element depicts on FIG. 1.

As illustrated on FIG. 2, the first sub-element 12 is provided with a connecting member 16 on the back face of said first sub-element 12. The first sub-element 12 further comprises a first protruding part 2 that extends along the front face of said first sub-element 12 and in a direction perpendicular to the thickness of said first sub-element 12. The second sub-element 14 comprises a second protruding part 4 that extends along the back face of said second sub-element 14 and in a direction perpendicular to the thickness of said second sub-element 14.

The facing element 10 is configured such that the first and second protruding parts 2 and 4 of the first and second sub-elements 12 and 14 extend into the gap 20. The facing element 10 is further configured such that first protruding part 2 faces the second protruding part 4.

Advantageously, despite being not connected to a reinforcement member, the sub-element 14 can be maintained on a facing by the first protruding part 2 of the first sub-element 12, once the linking device 22 is released and the facing element is part of a reinforced soil structure.

Figure 3:
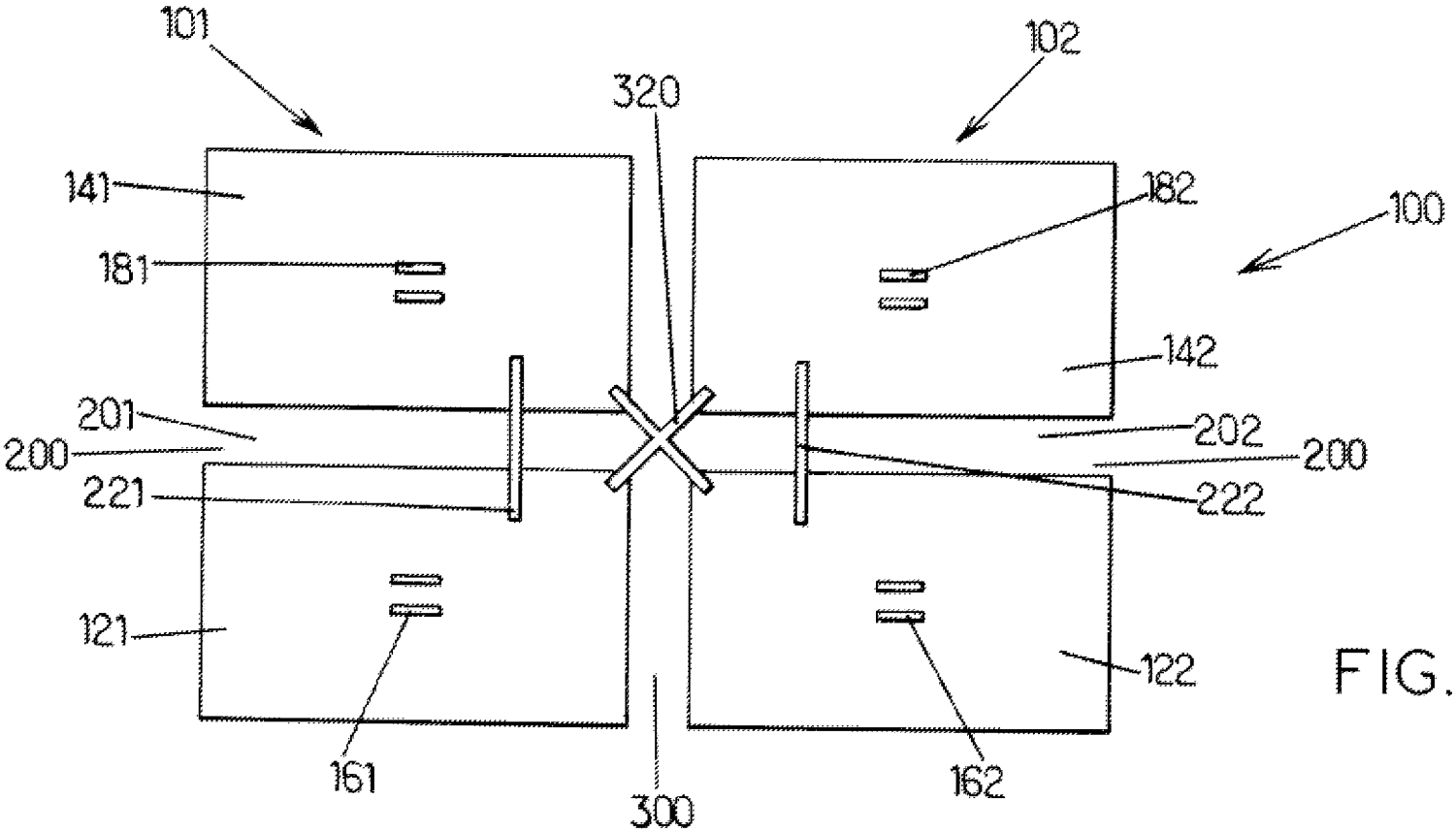
FIG. 3 is a schematic back view of a third embodiment of a facing element according to the invention.

A third embodiment of a facing element according to the invention is depicted on FIG. 3. Said facing element 100 comprises a first facing element 101 and a second facing element 102 according to the invention and a secondary linking device 320. Each of said facing elements 101 or 102 comprises a first sub-element 121 or 122, a second sub-element 141 or 142, separated by a gap 201 or 202 and linked together by a linking device 221 or 222. The first and second facing elements 101 and 102 are separated by a first gap 300 and linked together by the secondary linking device 320 such that to have constant relative position. Thus, the facing element according this third embodiment of the invention comprises four sub-elements 121, 122, 141 and 142. Each sub-element is provided with a connecting member 161, 162, 181 and 182 respectively. In an embodiment of the invention, at least one of said sub-elements is provided without a connecting member.

According to the embodiment of FIG. 3, the two facing element 101 and 102 are juxtaposed such that the gaps 201 and 202 of each elements form a longest second gap 200. In the embodiment of FIG. 3, the longitudinal direction of the first gap 300, and the longitudinal direction of the second gap 200 are substantially perpendicular.

As the gap of a facing element according to previous embodiments, the first and second gaps 200 and 300 may be, at least, partially filled with a compressive material, for example polystyrene, EPDM, polyethylene or cork. For example, a brick of compressive material is introduced into the gap. The size of the first and second gaps 300 or 200 and the filling material can be advantageously chosen in order to obtain a desired compressibility of the facing element. For example, the gap is filled with a material having a compressibility such that the overall compressive strain capacity of the facing element in at least one direction is comprised between 0.5% and 20%, preferably, between 1% and 5%. For example, the size and filling material of the gap 300 have an influence on the overall compressive strain capacity of the facing element in a direction perpendicular to the longitudinal direction of the gap 300.

According to the embodiment of FIG. 3, the overall compressive strain capacity of the facing element can be advantageously adapted in two directions perpendicular to each other.

According to the embodiment of FIG. 3, the linking device 320 is at the crossing of the first and second gaps 200 and 300. According to another embodiment of the invention, the linking device may be placed in another location, for example between the two second sub-elements 141 and 142 of the two facing elements 101, 102.

According to a further embodiment of the invention, the linking device 320 is designed so as to be removable or releasable. Thus mobility between the facing elements 101, 102 can be obtained, for example once the facing element 100 is part of a reinforced soil structure, giving to the facing element a greater compressibility. For example, the linking device 320 is arranged so as to break under a force greater than two times the weight of the said facing element. According to an embodiment of the invention, the linking device is arranged so as to naturally deteriorate over time, for example it is made in a material that deteriorates over 2 to 5 years.

Figure 4:
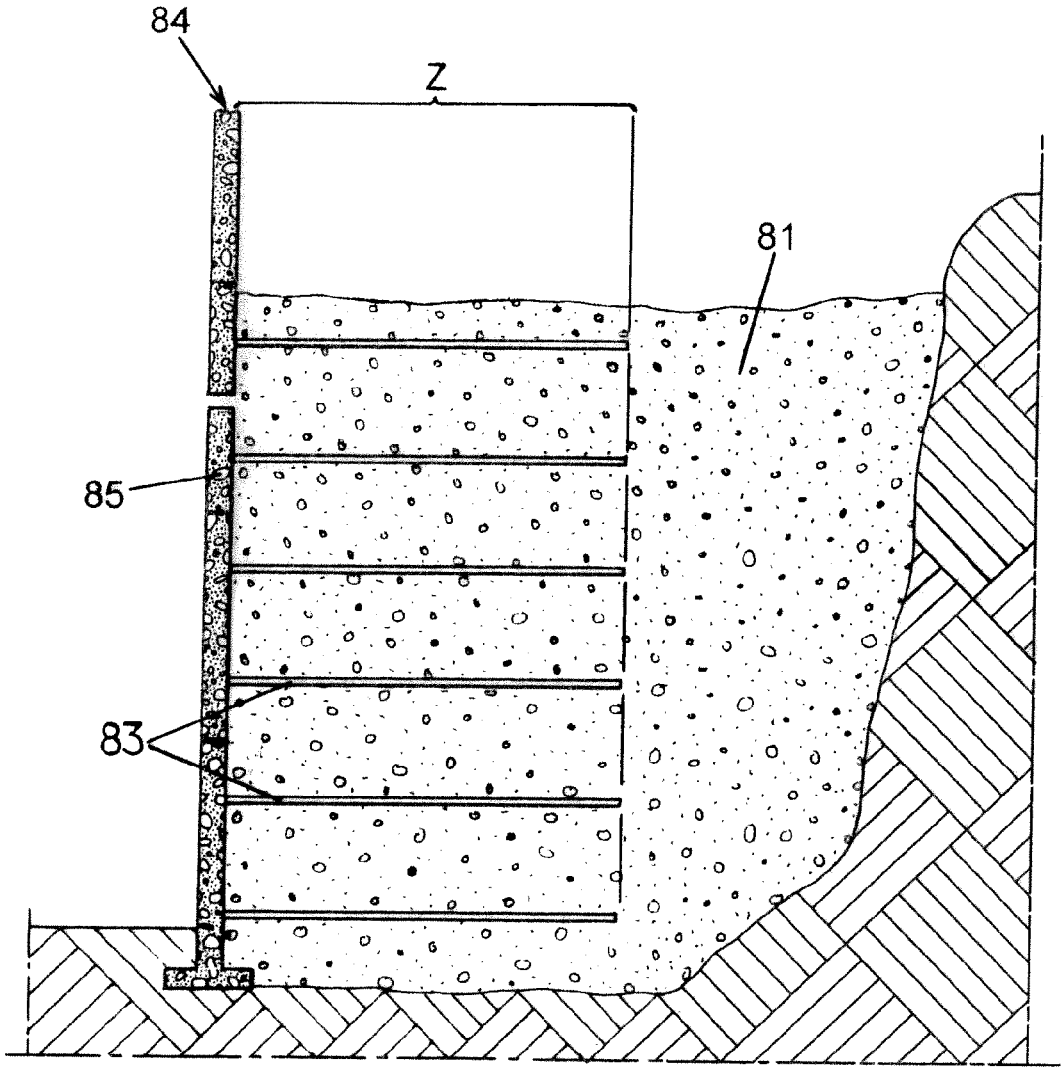
FIG. 4 is a schematic side view of a reinforced soil structure comprising a facing element according to the invention.

Another aspect of the invention relates to a reinforced soil structure, as depicted in FIG. 4. A reinforced soil structure according to the invention comprises a fill 81 delimited by a facing 84 made of prefabricated elements juxtaposed to cover the front face of the structure. A structure according to the invention further comprises, at least, one facing element 85 according to the invention.

After placement and compaction, a fill layer is loaded by the subsequent fill layers placed on top, and possibly by additional loading placed on top of the completed reinforced soil structures, such as: traffic loads, stockpiling of bulk or contained material, structural elements like concrete slabs, bridge decks, acoustic barriers, etc. Advantageously, introducing facing elements according to the invention in the facing of a reinforced soil structure provides a facing with a compressibility equivalent to the compressibility of the fill. This compressibility can be estimated and depends on the quality of the filling material and the subsequent loading applied to the layers of fill contiguous with the facing elements. Thus the facing may follow the contraction of the fill and the risks of breaking are drastically decreased.

According to another embodiment of the invention, the facing comprises a row of elements according to the invention. For example, said row of elements extends from one extremity of the facing to an other.

A structure according to the invention further comprises reinforcement members 83 extending through a reinforced zone Z of the fill 81 situated behind said front face. Said reinforcement members 83 are selected among the following list consisting of: synthetic strip, metal strip, metal bar, strip shaped metal grid, sheet shaped metal grid, ladder shaped metal grating, synthetic strip, sheet shaped synthetic grid, ladder shaped synthetic grid, geotextile layer, and geocell.

In a reinforced soil structure according to the invention, at least one sub-element of each element according to the invention of the facing is connected to, at least, one of said reinforcement members. According to the embodiment of FIG. 4, each facing sub-elements are connected to, at least, a reinforcement member. Preferably, each facing elements are connected to, at least, a reinforcement member extending through a reinforced zone of the fill situated behind said front face.

Another aspect of the invention provides a method for building a reinforced soil structure. For example, for building the structure of FIG. 4 with a facing element according to the embodiment of FIG. 1, said method comprises the following steps:

a) positioning a facing element 85 according to the invention along the front face of the structure delimiting a volume to be filled, so as to be able thereafter to introduce fill material over a certain depth. In a known way, the erection and positioning of the facing element may be made easier by assembly members placed between them;

b) connecting at least one reinforcement member 83 to a connecting member of the first facing sub-element so as to have the reinforcement member extend through a reinforced zone Z situated behind said front face;

c) introducing fill material into said volume over, at least, the reinforced zone in which the reinforcement member which has just been installed extends, and compacting the fill material;

d) repeating the two preceding steps for the second facing sub-element of the facing element according to the invention.

According to an embodiment of the invention, the linking device is broken by the stress induced by the second fill compacting step.

According to an embodiment, the building method of the invention may further comprise the step of removing the linking device between facing sub-elements, for example if the linking device is not designed to break or naturally deteriorate.

According to an embodiment of the invention, for example when a facing element according to the embodiment of FIG. 2 is used, the filling material may be introduced in step c) over all the volume delimited by the facing element. The step d) is then not performed. The second protruding part 4 of the second sub-element 14 is pushed against the first protruding part 2 of the first sub-element 12 by the fill once the fill material has been introduced in the reinforced zone. The pressure applied by the fill material against the second sub-element 14 and the friction between the first and second protruding parts 2 and 4 maintain the gap between the two sub-elements 12 and 14 when the linking device is removed.

The invention has been described above with the aid of example embodiments without limitation of the general inventive concept. It should be noted that numerous alternatives may be applied to the structure described hereinabove and to its method of production.

The invention claimed is:

1. A facing element for reinforced soil structures comprising:

a first facing sub-element comprising at least one connecting member configured to connect at least one reinforcement member to said first facing sub-element, a second facing sub-element, and a linking device, wherein said first and second facing sub-elements are separated by a gap and are linked together by the linking device such that the first and second facing sub-elements have constant relative position with respect to each other, and wherein the gap is filled with a material having a compressibility such that the overall compressive strain capacity of the facing element in at least one direction is comprised between 0.5% and 20%.

2. The facing element according to claim 1, wherein said second facing sub-element comprises at least one connecting member configured to connect at least one reinforcement member to said second facing sub-element.

3. The facing element according to claim 1, wherein the material filling the gap has a compressibility such that the overall compressive strain capacity of the facing element in the at least one direction is comprised between 1% and 5%.

4. The facing element for reinforced soil structures comprising at least two facing sub-elements according to claim 1 and a secondary linking device, wherein the at least two facing sub-elements are separated by a second gap and linked together by the secondary linking device such that the at least two facing sub-elements have constant relative position with respect to each other.

5. The facing element according to claim 4, wherein the second gap separating the at least two facing elements has a longitudinal direction substantially perpendicular to the longitudinal direction of the gaps separating the sub-elements forming said facing elements.

6. A reinforced soil structure comprising:

a fill;

a facing made of concrete made of at least one facing element for reinforced soil structures comprising:

a first facing sub-element comprising at least one connecting member configured to connect at least one reinforcement member to said first facing sub-element, a second facing sub-element, and a linking device, wherein said first and second facing sub-elements are separated by a gap and are linked together by the linking device such that the first and second facing sub-elements have constant relative position with respect to each other, the at least one facing element being placed along a front face of the structure, the linking device being in direct contact with a face of the first facing sub-element and a face of the second facing sub-element;

wherein the at least one reinforcement member extends through a reinforced zone of the fill situated behind said front face;

wherein at least one facing sub-element of said at least one facing element is connected to the at least one reinforcement member extending through a reinforced zone of the fill situated behind said front face, and wherein the linking device is configured so as to be removed or released while maintaining a connection between the at least one reinforcement member and the at least one facing element.

7. The structure according to claim 6, wherein the facing comprises, at least, one row of elements according to claim 1, at least one facing sub-element of said at least one facing element being connected to, at least, the at least one reinforcement member extending through the reinforced zone of the fill situated behind said front face.

8. The structure according to claim 6, wherein the at least one reinforcement member is at least one of synthetic strip, metal strip, metal bar, strip shaped metal grid, sheet shaped metal grid, ladder shaped metal grating, synthetic strip, sheet shaped synthetic grid, ladder shaped synthetic grid, geotextile layer, and geocell.

9. The reinforced soil structure according to claim 6, wherein the linking device is arranged so as to break under a force greater than two times the weight of the said facing element.

10. The reinforced soil structure according to claim 6, wherein the linking device is arranged so as to naturally deteriorate over time.

11. A method for building a reinforced soil structure, comprising the steps of:

positioning a facing element for reinforced soil structures along a front face of the structure delimiting a volume to be filled, the facing element for reinforced soil structures comprising:

a first facing sub-element comprising at least one connecting member configured to connect at least one reinforcement member to said first facing sub-element, a second facing sub-element, and a linking device, wherein said first and second facing sub-elements are separated by a gap and are linked together by the linking device such that the first and second facing sub-elements have constant relative position with respect to each other the linking device being in direct contact with a face of the first facing sub-element and a face of the second facing sub-element, connecting the at least one reinforcement member to the at least one connecting member of the first facing sub-element so as to have the at least one reinforcement member extend through a reinforced zone situated behind said front face, the linking device being configured so as to be removed or released when the facing element is part of a reinforced soil structure while maintaining a connection between the at least one reinforcement member and the facing element, introducing fill material into said volume over, at least, the reinforced zone in which the at least one reinforcement member extends, and compacting the fill material, and removing the linking device between the first and second facing sub-elements.

* * * * *